United States Patent [19]

Werk

[11] Patent Number: 5,029,433

[45] Date of Patent: Jul. 9, 1991

[54] STRAPPER

[75] Inventor: Jürgen Werk, Wuppertal, Fed. Rep. of Germany

[73] Assignee: Hoesch Aktiengesellschaft, Dortmund, Fed. Rep. of Germany

[21] Appl. No.: 446,994

[22] Filed: Dec. 6, 1989

[30] Foreign Application Priority Data

Dec. 9, 1988 [DE] Fed. Rep. of Germany ..... 3841489

[51] Int. Cl.[5] ..... B65B 13/30

[52] U.S. Cl. ..... 53/592; 53/582; 100/29; 140/932

[58] Field of Search ..... 53/582, 592; 29/283.5, 29/521; 100/29, 32, 33 R; 140/93.2, 93.4, 152

[56] References Cited

U.S. PATENT DOCUMENTS

| | | | |
|---|---|---|---|
| 2,549,626 | 4/1951 | Mosey | 140/93.2 |
| 3,241,579 | 3/1966 | Partridge | 140/93.2 |
| 3,319,666 | 5/1967 | Langford et al. | 140/152 X |
| 3,442,734 | 5/1969 | Ericsson | 53/592 X |
| 3,621,888 | 11/1971 | Ericsson | 140/93.2 |
| 3,728,779 | 4/1973 | Behlen et al. | 29/521 X |
| 3,804,001 | 4/1974 | Longerich et al. | 100/29 X |
| 4,159,725 | 7/1979 | Bachmann et al. | 140/93.2 |
| 4,398,572 | 8/1983 | Fromm | 140/93.2 |
| 4,627,142 | 12/1986 | Hornak | 29/283.5 |

FOREIGN PATENT DOCUMENTS 2118265 10/1983 United Kingdom ..... 100/32

*Primary Examiner*—John Sipos
*Assistant Examiner*—Linda B. Johnson
*Attorney, Agent, or Firm*—Max Fogiel

[57] ABSTRACT

Strapper with a mechanism that has a tensioning wheel and tensions a section or steel strap obtained from a supply role and wrapped around a package and with a mechanism that has a stationary lower jaw and an upper jaw that executes a punching motion, fastening together the overlapping ends of the strap with at least two pairs of angled cuts positioned along the strap. The upper jaw that executes the punching motion is mounted and operated such that, as it executes its intended punching motion, one of the pairs of angled cuts begins to be introduced before the other pair does. To introduce the pairs of angled cuts, the operating surface of the upper jaw, the surface, that is, that faces the lower jaw, executes an essentially roller motion over the operating surface of the lower jaw combined with a motion that approaches the upper jaw to the lower jaw, so that the motion that introduces the first pair of angled cuts to begin terminates before the next pair of cuts to begin.

11 Claims, 6 Drawing Sheets

STRAPPER

The invention concerns a strapper with a mechanism that has a tensioning wheel and tensions a section of steel strap obtained from a supply role and wrapped around a package and with a mechanism that has a stationary lower jaw and an upper jaw that executes a punching motion, fastening together the overlapping ends of the strap with at least two pairs of angled cuts positioned along the strap, whereby the upper jaw that executes the punching motion is mounted and operated such that, as it executes its intended punching motion, one of the pairs of angled cuts begins to be introduced before the other pair does.

This strapper is known from German OS 3 131 224. The strap is wrapped around the package and the strapper slid over the overlapping ends of the strap. The strapper has for this purpose a lateral recess that allows the overlapping ends of the strap to be positioned between a base plate that incorporates the lower jaw and the upper jaw that executes the punching motion. The wheel in the tensioning mechanism is also positioned above the overlapping ends of the strap, allowing the strap to be tensioned around the package first. Once the strap has been tensioned, the fastening mechanism is activated to fasten together the overlapping ends of the strap. The fastening is embodied in three pairs of angled cuts positioned along the strap at its overlapping ends. The jaws, which operate in conjunction, have cutting edges that curve out in the cutting direction, and, when the pairs of angled cuts are introduced, the sections of strap between each pair are forced up in a curve out of the plane of the strap and the lateral sections created by the pairs of angled cuts are forced down in a curve out of the plane of the strap. Once the excess strap leading to the supply roll has been trimmed off, the tensioning mechanism is released and the overlapping ends of the strap slide somewhat toward each other, forcing and hooking together the projecting corners created by the angled cut in the upper end of the strap and in the lower end of the strap.

A pair of angled cuts is introduced in the overlapping ends of the strap by exerting a force on the upper jaw that executes the punching motion. This force is not constant over the whole motion of the jaw, but must be most powerful at the beginning of the process of introducing the pair of cuts, when the flat backs of the cutting edges that curve out in the cutting direction must be simultaneously introduced to a considerable extent into the overlapping ends of the strap. As the motion of cutting each pair of angled cuts continues, a simple shearing action occurs, requiring less force. To prevent the maxima of the requisite forces from coinciding when three pairs of angled cuts are introduced along the circumference of the strap, the upper jaw that executes the punching motion in the known strapper is mounted on a lever with a pivoting axis that extends across the strap at least approximately in the plane of operation of the strapper's components and specifically on the side of the jaw that faces away from the tensioning mechanism. Thus, the introduction of pairs of angled cuts commences with the introduction of the pair nearest the pivoting axis of the pivoting upper jaw. Once the first pair of angled cuts has been partly introduced, the second pair is commenced and, once the second pair has been partly introduced, the third pair is commenced. All of the pairs are then cut farther until completion of the motion of the pivoting upper jaw, at which time a relatively powerful force is also needed. Just before the pivoting upper jaw completes its motion, a notching blade mounted on the jaw comes into action. The notching blade must force itself into the upper end of the strap because the bottom end of the strap is resting on the strapper's base plate that supports the overlapping ends of the strap. Another powerful force is needed just before completion of the punching motion to obtain the notching action. To make it possible to exert such powerful forces the upper jaw must be activated with a relatively long lever. The strapper and especially the base plate that supports the strap ends must also be relatively strong in order to resist the forces that occur. Mounting the upper jaw on a lever with an axis that extends across the strap at least approximately in the plane of operation of the strapper's components necessarily entails the drawback that the punching motion of the upper jaw must be limited by a stationary stop to ensure that all pairs of angled cuts are equally deep and long, so that the tension will be uniformly distributed over all the cuts. This precise limitation of the upper jaw's punching motion demands, however, precise dimensioning and positioning of the notching blade to ensure that the upper end of the strap will be cut through even though the punching motion is limited.

The object of the invention is to improve a strapper of the aforesaid type and especially to keep the overall force that must be applied to the upper jaw that executes the punching motion relatively weak.

This object is attained in accordance with the invention in that, to introduce the pairs of angled cuts, the operating surface of the upper jaw, the surface, that is, that faces the lower jaw, executes an essentially rolling motion over the operating surface of the lower jaw combined with a motion that approaches the upper jaw to the lower jaw, so that the motion that introduces the first pair of angled cuts to begin terminates before the next pair of cuts to begin. This is a simple means of ensuring not only that the motions that initiate introduction of the angled cuts occur in succession but also that the procedure of cutting the first pair of cuts to begin terminates before that of cutting the next pair of cuts to begin. The various forces that are necessary during the process of cutting each pair of cuts are accordingly distributed more uniformly in a simple way over the total cutting process and force peaks are avoided. This is attained in that the operating surface of the upper jaw that faces the lower jaw executes an essentially rolling motion over the operating surface of the lower jaw combined with a motion that approaches the upper jaw to the lower jaw. The rolling motion ensures that, when a succession of several pairs of angled cuts are introduced, the process not only begins with the beginning of the cuts in succession but the introduction of the pair of angled cuts also terminates in succession.

The operating surface of the upper jaw that faces the lower jaw can be curved to match its rolling motion. This is a simple means of ensuring that, in spite of the rolling punching motion of the upper jaw, the outward curves of the middle section and the lateral section at each pair of angled cuts will be equal and that the lengths of the cuts in each pair will be equal.

The end of the upper jaw that faces away from the operating surface can have a perforation to allow interlocking accommodation of a cam that is driven by a shaft, and the end that has the operating surface can be secured by a lateral stop in a groove that extends perpendicular to the operating surface of the lower jaw, whereby the pivoting axis constituted by the lateral stop is positioned more or less in the same plane as the operating surface of the upper jaw. The upper jaw that executes the punching motion is accordingly simply designed in the form of a sliding rocker and can accordingly simply execute the desired combination of rocking and approaching motions. Since the upper jaw has an interlocking perforation that accommodates a cam on a driven shaft, both the upper jaw's approach to the lower jaw and its return to its rest position remote from the lower jaw will be channeled, allowing the overlapping ends of the strap to be introduced between the jaws and removed again once the pair of angled cuts has been punched in. The end of the upper jaw that has the operating surface is secured by a lateral stop in a groove in the housing that extends perpendicular to the operating surface of the lower jaw. This is a simple means of ensuring that the end of the upper jaw that has the operating surface is channeled such that the two jaws will reliably operate in conjunction. Since the pivoting axis constituted by the lateral stop on the upper jaw is positioned more or less in the same plane as the operating surface of the upper jaw, no displacement along the strap will occur when the operating surface of the upper jaw engages as intended the surface of the overlapping ends of the strap.

The shaft that has the cam for the upper jaw can be positioned perpendicularly above the midline of the lower jaw and the groove that secures the lateral stop on the upper jaw can also extend perpendicularly along the midline of the lower jaw. This is a simple means of centering the upper jaw, which acts as a sliding rocker, along the midline of the fastening that consists of several pairs of angled cuts. The pivoting motion of the cam on the driveshaft that is necessary to ensure the intended punching process on the part of the upper jaw can be limited to specific sections on each side of the lower deadpoint. The driveshaft that has the cam need not accordingly be rotated 360°, which would at any rate be impossible to do with an activating lever mounted on the shaft, in order to use the strapper for its intended purpose. In order to execute the requisite punching motion with the upper jaw it is only necessary to shift the shaft and its cam into the vicinity of the lower dead point and specifically to either side of that point. The rolling motion will accordingly occur in the immediate vicinity of the lower dead point and the requisite motion of the upper jaw toward or away from the lower jaw will occur as the distance away from the dead point increases.

When the punching process is carried out as intended, the jaws can initially become active on the pair of angled cuts that is to be introduced farthest away along the circumference from the tensioning mechanism and eventually on the pair that is nearest the tensioning mechanism. The tensioning mechanism exerts, especially when it is tensioned, a force on the base plate in that the tensioning wheel presses down on the overlapping ends of the strap that rest on the plate. The force exerted on the plate depends on the tension on the strap. As the process of introducing the pairs of angled cuts commences with the pair that is farthest away from the tensioning mechanism, the stress produced on the base plate by the punching process occurs far away from the stress produced by the tensioning wheel, and these stresses can easily be accommodated by the base plate. As the cutting process continues, the stress produced on the base plate by the cutting constantly migrates nearer the point that is being stressed by the tensioning wheel. As the cuts continue to be introduced, however, the tension that prevails in the strap will already be accommodated to some extent by the cut and by the jaw as it extends into the cut, and the tensioning mechanism will no longer have to accommodate all of the tension in the strap. The stress exerted on the base plate by the tensioning mechanism, however, will be weaker, and it will no longer be possible to exert any great stress on the base plate even when the pair of cuts that is next to the tensioning mechanism is being introduced.

The lateral stop on the upper jaw can have a round cross-section and engage a bore in a sliding block in the groove. The engagement of the cylindrical stop in the bore in the sliding block and the position of the block in the groove is a simple and reliable means of ensuring a low-friction guide for the end of the upper jaw that has the operating surface.

The end of the sliding block accommodating the cylindrical lateral stop on the upper jaw that faces the lower jaw can have at least one lifter that engages below the edges of the ends of the strap between the jaws. The lifter on the sliding block is a simple means of extracting the overlapping ends of the strap out of the lower jaw once the angled cuts have been introduced and while the upper jaw is being returned to its rest position, in which it is remote from the lower jaw.

The shaft with the cam that drives the upper jaw can be pivoted with a manually operated lever. Just activating the shaft with the lever can accordingly shift the upper jaw out of its rest position and into the punching position and back out of the punching position and into the rest position.

The surface of the upper jaw that operates in conjunction with the lower jaw can be somewhat elongated toward the tensioning mechanism along the wrapping direction and have an in-itself known notching blade for separating the tensioned strap leading to the supply roll. The punching motion of the upper jaw accordingly becomes a simple means of removing the excess strap leading to the supply roll from the package.

The notching blade is positioned such that the rolling motion of the operating surface on the upper jaw over the operating surface of the lower will account for the actual notching once the final pair of cuts has been completely introduced.

One embodiment of the invention will now be described with reference to the drawing, wherein FIG. 1 is a partly broken side view of a strapper in accordance with the invention and FIGS. 2 through 8 are schematic illustrations of the lower jaw and of the upper jaw that executes the punching motion, the upper jaw being represented in different positions.

Figure 1:
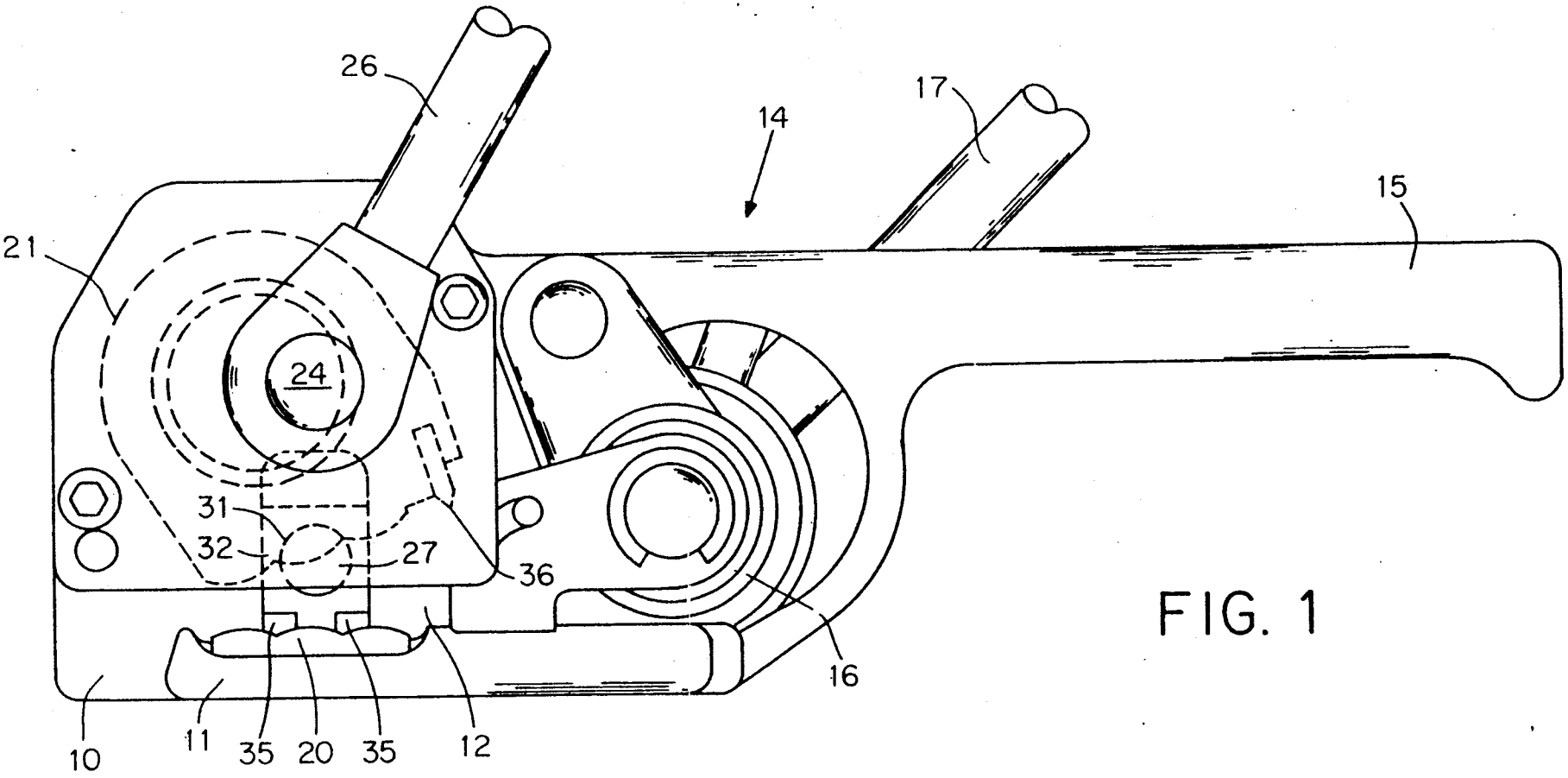

The strapper illustrated in the drawing consists of a housing 10 with a handle 15 and a base plate 11. Between housing 10 and base plate 11 is a laterally open slot 12 that accommodates the overlapping ends 13 of a steel packaging strap. The strap is wrapped around an unillustrated package and the slot 12 on the strapper slipped over the overlapping ends of the strap. To allow this procedure, a tensioning mechanism 14 that pivots on housing 10 must be released by pivoting it with a lever 17 against the tensioning direction, releasing a tensioning wheel 16 from base plate 11 and allowing the overlapping ends 13 of the strap to be introduced into slot 12. Once the strapper has been positioned over the overlapping ends 13 of the strap, lever 17 is released and tensioning mechanism 14 will assume its operating position subject to an unillustrated energy-storage device wherein the tensioning wheel 16 in tensioning mechanism 14 rests against the upper surface of the overlapping ends 13 of the strap. The wheel can now be rotated with lever 17 to tension the strap around the unillustrated package. Once the strap has been provided with the requisite tension, a fastening can be established in its overlapping ends 13.

The fastening in the illustrated example comprises three in-themselves known pairs of angled cuts 13*a* introduced in the overlapping ends 13 of the strap. The unillustrated pairs of angled cuts are positioned along the strap. When pairs of angled cuts are introduced, not only are the cuts introduced but the sections 18 between the cuts are simultaneously forced up in a curve out of the plane of the strap and the lateral sections 19 created by the cuts are forced down in a curve out of the plane of the strap. Once the tensioning mechanism 14 has been released, accordingly, the projecting corners created by the angled cut in one end of the strap can be forced and hooked behind the projecting corners in the other end of the strap.

The angled cuts are introduced with a lower punching jaw 20 and with an upper punching jaw 21. Lower punching jaw 20 is secured stationary on base plate 11 and upper punching jaw 21 is accommodated in housing 10 and executes the punching motion.

The end of upper punching jaw 21 that faces away from its operating surface 22 has a perforation 23 for the interlocking accommodation of a cam 25 that is driven by a shaft 24. As will be especially evident from FIG. 1, the shaft 24 that drives cam 25 can be activated with a lever 26. At the end that has operating surface 22, upper punching jaw 21 is secured in a groove 28 by a lateral stop 27. The groove extends perpendicular to the operating surface 29 of lower punching jaw 20, whereby the pivoting axis 30 constituted by lateral stop 27 is positioned more or less in the same plane as the operating surface 22 of upper punching jaw 21. The shaft 24 that has the cam 25 that drives upper punching jaw 21 is positioned perpendicularly above the midline of lower punching jaw 20. The groove 28 that secures the lateral stop 27 on upper punching jaw 21 extends perpendicularly along the midline of lower punching jaw 20. The pivoting motion of the cam 25 on shaft 24 that is necessary for the intended punching action on the part upper punching jaw 21 is simultaneously restricted to subordinate areas on each side of the lower dead point.

To carry out the intended punching process, punching jaws 20 and 21 initially introduce the pair of angled cuts that is farthest away from tensioning mechanism 14 in the strapping direction. The middle pair is then introduced and finally the pair that is nearest tensioning mechanism 14.

Figure 2:
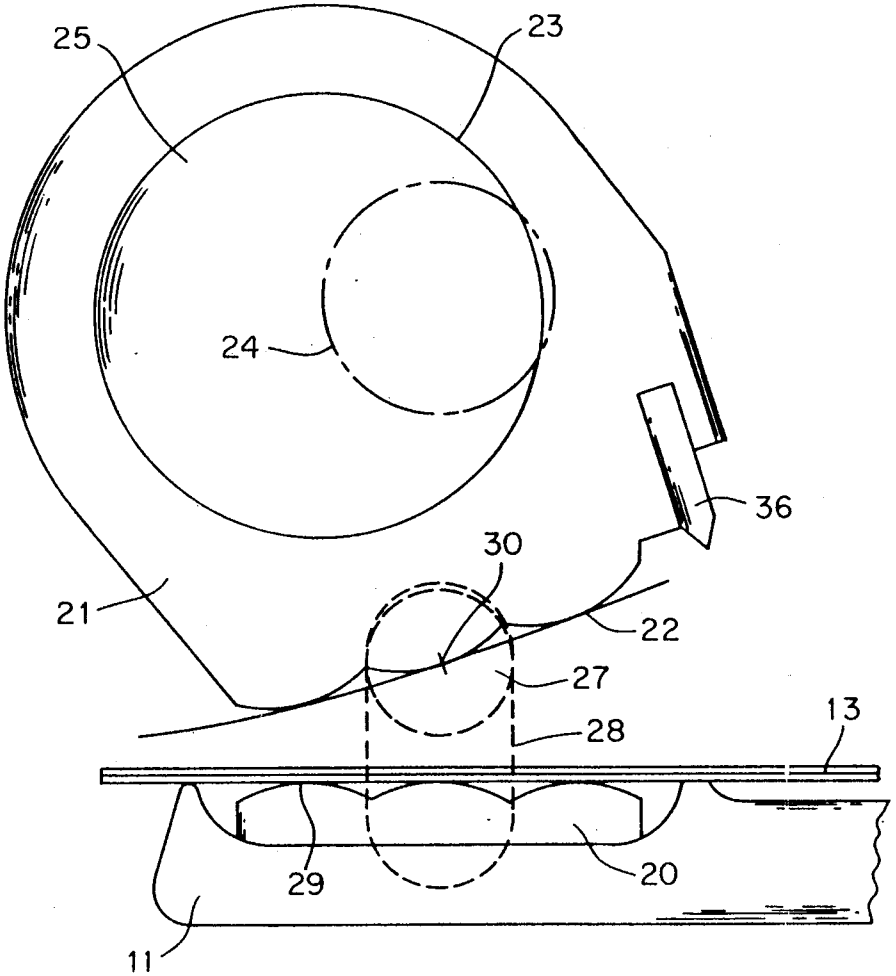

The cam 25 that drives upper punching jaw 21 causes, in conjunction with the position of lateral stop 27 in perpendicular groove 28, upper punching jaw 21 to execute a motion similar to that of a sliding rocker. The various positions of upper punching jaw 21 that occur during the punching process are illustrated in FIGS. 2 through 8. FIG. 2 represents upper punching jaw 21 in its rest position. The operating surface 22 of upper punching jaw 21 is positioned far enough away from the operating surface 29 of lower punching jaw 20 to allow the overlapping ends of the strap to be introduced between jaws 20 and 21 and, once the wrapping process has been completed, to allow the strapper to be removed from the strap. Lever 26, which is not illustrated in FIGS. 2 through 7, is activated to rotate shaft 24 and hence also cam 25, linearly displacing upper punching jaw 21, which is still secured in the groove 28 in housing 10 by lateral stop 27. Lateral stop 27 is illustrated in FIGS. 2 through 7 in the form of a cylindrical pin, with an axis that constitutes the axis of rotation of upper punching jaw 21. As will be evident from FIG. 1, the cylindrical lateral stop 27 on upper punching jaw 21 can also engage a bore 31 in a block 32 that slides back and forth in groove 28. The result is a reliable and low-friction channeling in groove 28.

Figure 3:
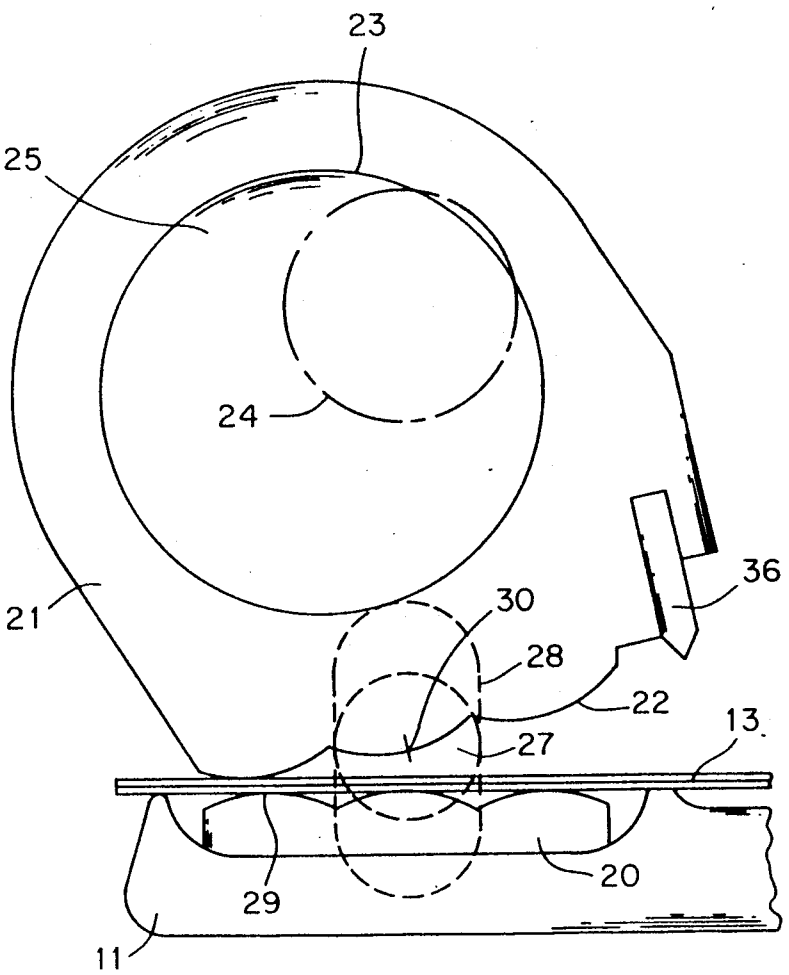

Upper punching jaw 21 is represented in FIG. 3 in the position in which its operating surface 22 has just come into contact with the upper surface of the overlapping ends 13 of the strap, which are resting on the operating surface 29 of lower punching jaw 20. This is the position that immediately proceeds the beginning of the actual punching process. It will, however, already be evident that the first pair of cuts to be introduced is the pair farthest away from the tensioning mechanism.

Figure 4:
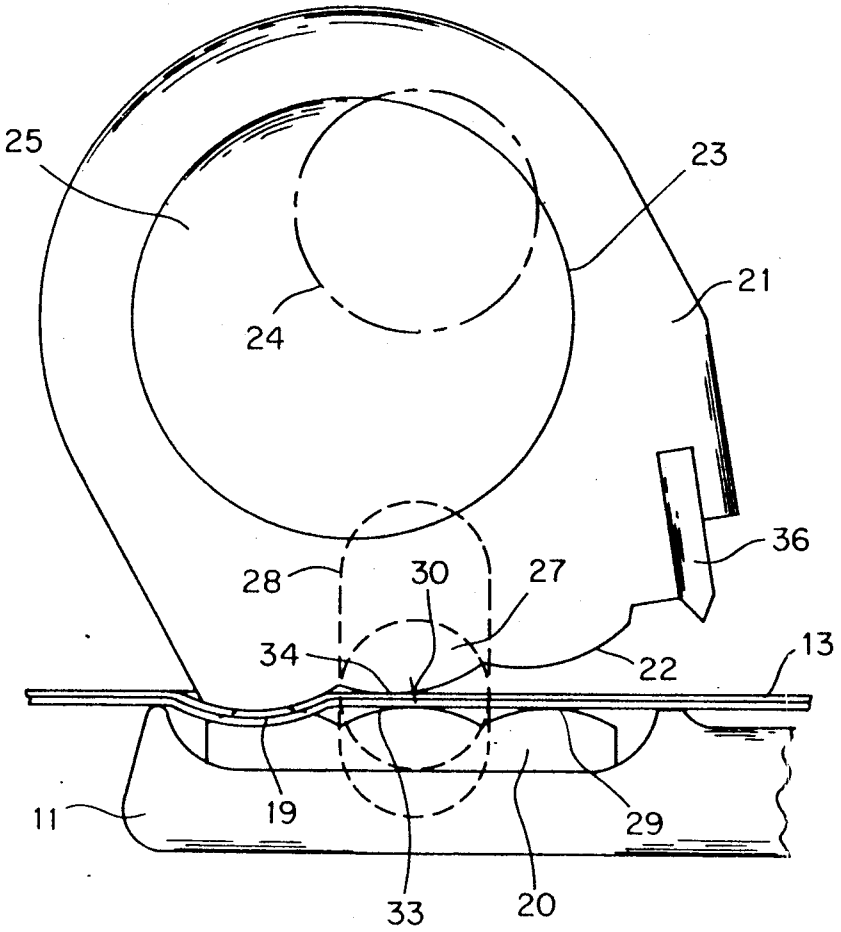

FIG. 4 represents upper punching jaw 21 in the position in which the introduction of the middle pair of angled cuts has not yet been commenced. The corresponding curved projections 33 and 34 have just come to rest against the upper and lower surface of the overlapping ends 13 of the strap. The first pair of angled cuts has been almost completely introduced in the overlapping ends 13 of the strap.

Figure 5:
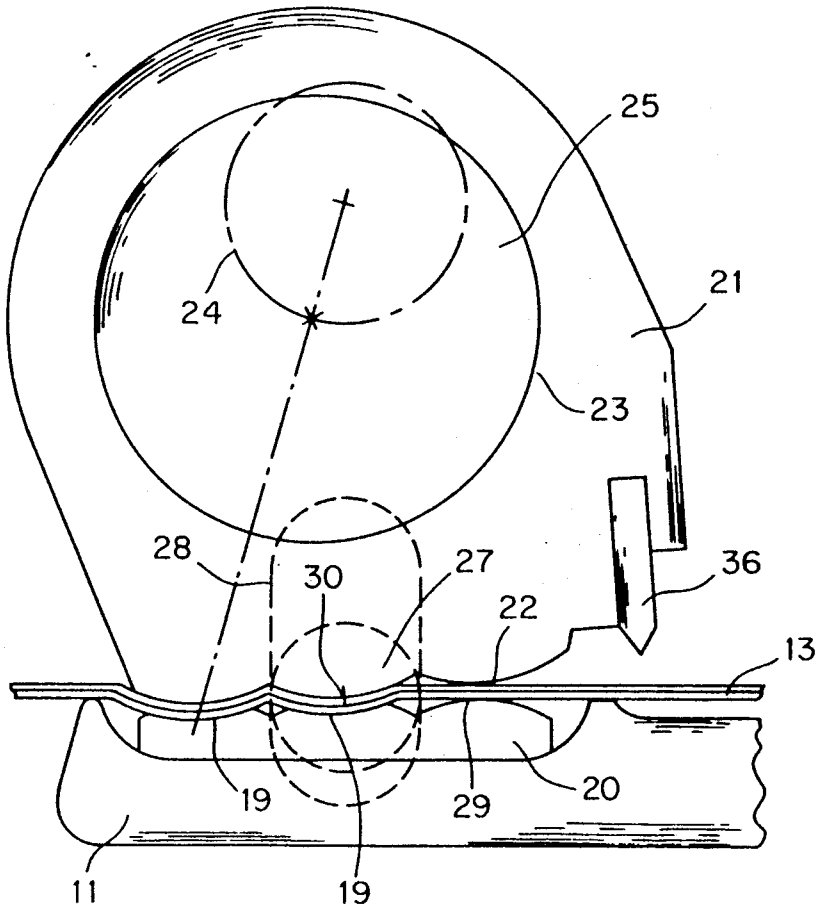

FIG. 5 represents upper punching jaw 21 in the position in which the introduction of the third pair of angled cuts, nearest tensioning mechanism 14, has been commenced. The second pair has also been almost completely introduced.

Figure 7:
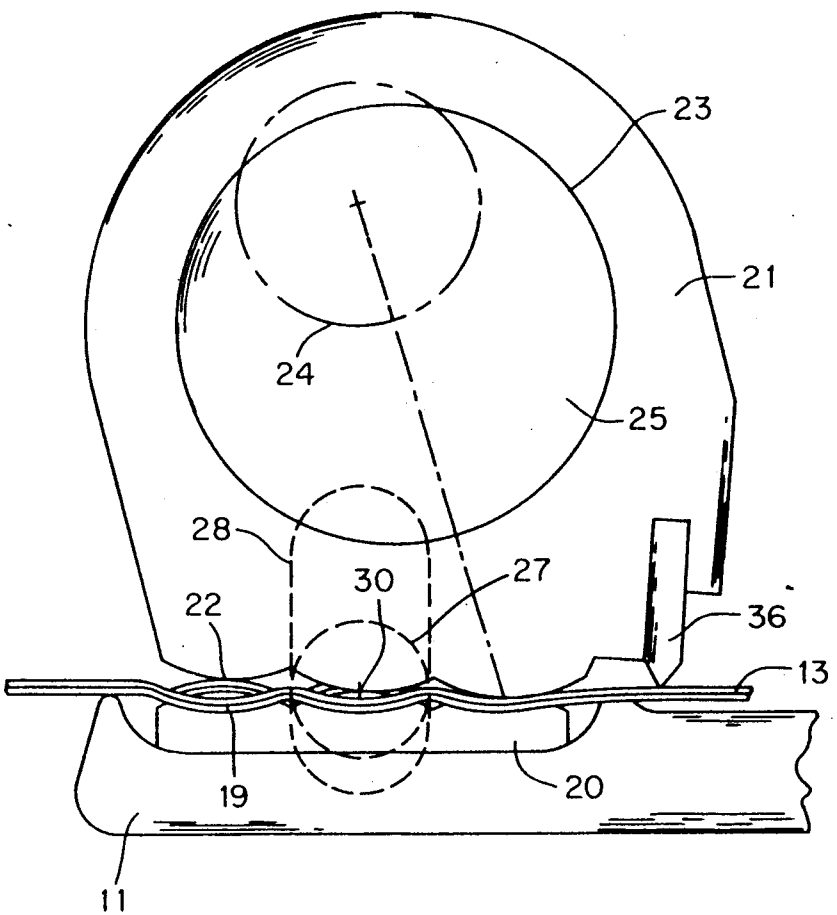
Figure 6:
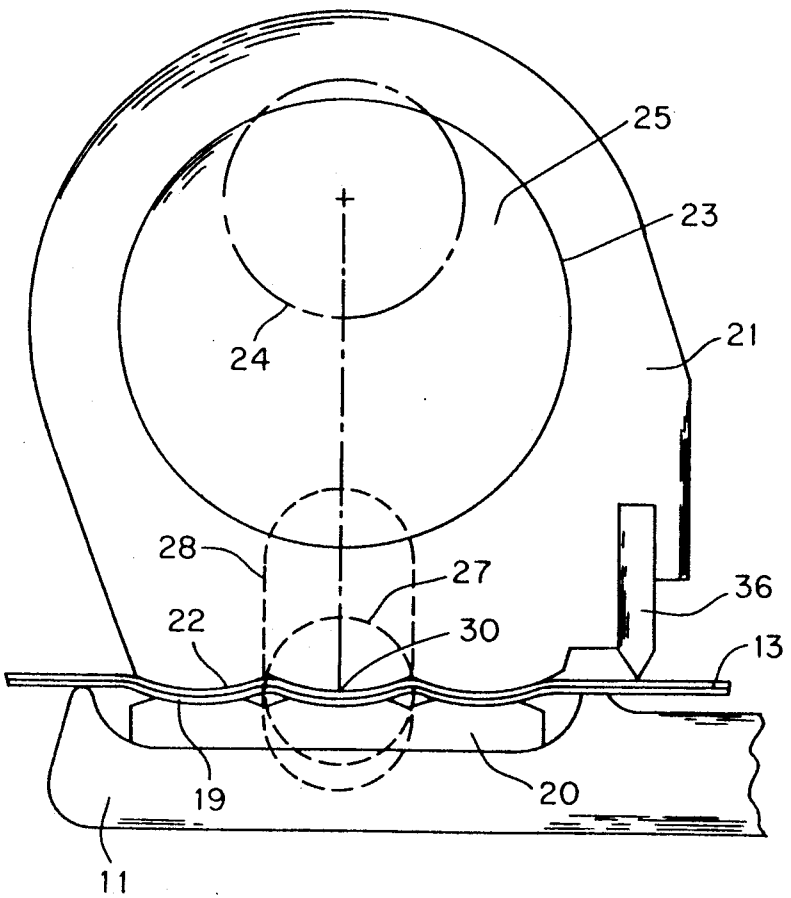
Figure 8:
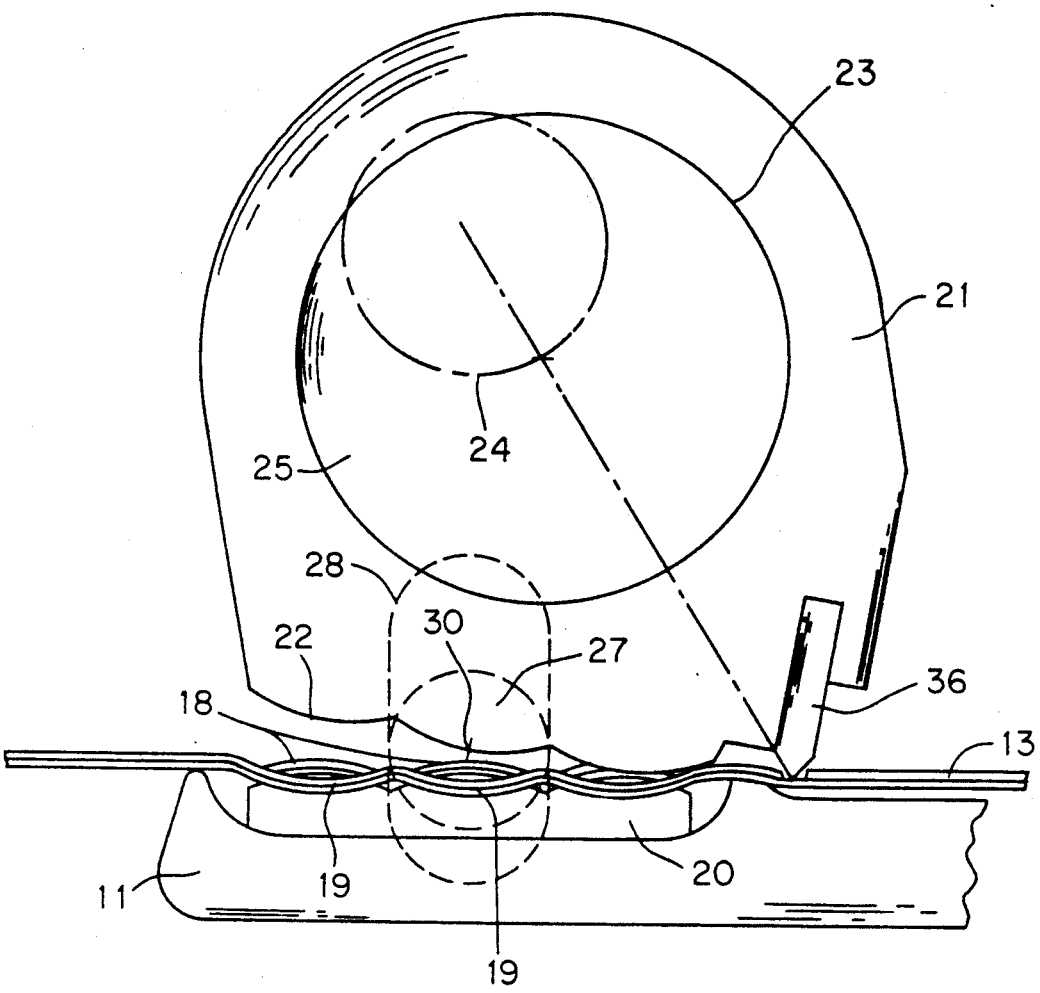
Figure 9:
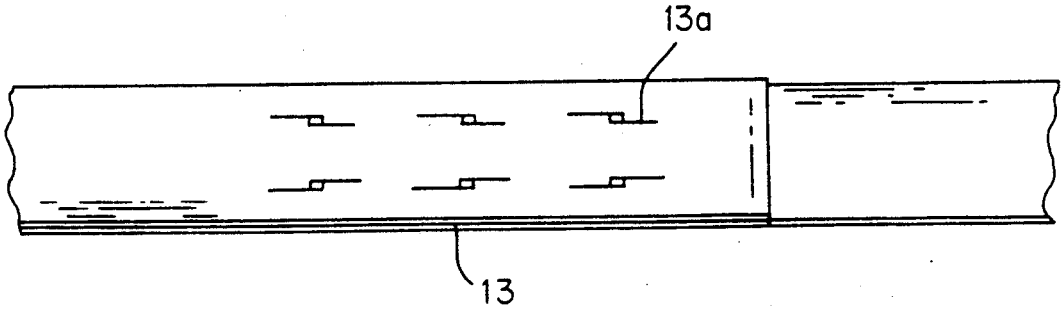
FIG. 9 is a top view of the angled cuts on a strap.
Figure 10:
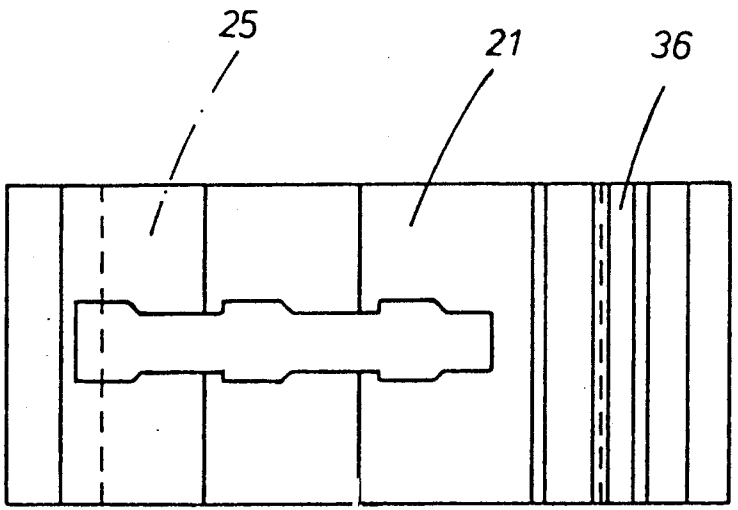
FIG. 10 is a plan view of the working face of the upper jaw.

FIG. 6 represents upper punching jaw 21 in the position in which the third pair of angled cuts has only been partly introduced. The first and second pairs have already been completely introduced. FIG. 7 represents the upper punching jaw in the position in which the third pair of angled cuts has been completely introduced into the overlapping ends of the strap. The processes of introducing the first, second, and third pair of angled cuts are accordingly commenced successively in a simple way and also terminated successively. This is a simple means of avoiding severe stress.

To attain the successive commencement and termination of the individual cutting processes, the operating surface 22 of upper punching jaw 21 has executed an essentially rolling motion over the operating surface 29 of lower punching jaw 20. The operating surface 22 of upper punching jaw 21 that faces lower punching jaw 20 is curved to match its rolling motion. The operating surface 22 of upper punching jaw 21 that operates in conjunction with lower punching jaw 20 is slightly elongated along the circumference toward tensioning mechanism 14 and has an in-itself known notching blade 36 for separating the excess strap that leads to the supply roll. Upper punching jaw 21 accordingly also has in a simple way a notching blade 36 for simultaneously separating the excess strap along with the punching motion. The rolling motion of the upper punching jaw can simultaneously, as will be especially evident from FIG. 8, be exploited to carry out the notching process once the pairs of angled cuts have been completely introduced. The notching is accordingly carried out before the pairs of angled cuts are introduced, allowing the cuts to be carried out to the desired length and depth independent of the notching, which has a positive effect on the strength of the fastening. Once the three pairs of angled cuts have been completely introduced into the overlapping ends 13 of the strap and once the excess strap has been notched off, lever 26 is activated to return upper punching jaw 21 to its rest position, which is illustrated in FIG. 2.

As will be especially evident from FIG. 1, the end of the block 32 that accommodates the cylindrical lateral stop 27 on upper punching jaw 21 that faces lower punching jaw 20 has two lifters 35 that engage below the edges of the ends 13 of the strap between jaws 20 and 21. This is a simple means of forcing upper punching jaw 21 into its rest position when lever 26 is moved back as well as forcing the overlapping ends 13 of the strap off of lower punching jaw 20.

As has already been mentioned herein, the embodiment described herein is only one example of the invention, which is not restricted to it. Many other embodiments and versions are also possible. The upper punching jaw for example, which is in one piece in the embodiment described herein, can also be in two parts, with the actual die consisting of a flat plate secured to a base.

What is claimed is:

1. A strapping device comprising: a tensioning wheel for tensioning a section of a steel strap obtained from a supply roll and wrapped around a package with overlapping ends; a stationary lower jaw with an operating surface and an upper jaw, said upper jaw executing a punching motion to produce at least two pairs of angled cuts in and along said overlapping ends of said strap for fasteneing together said overlapping ends; said upper jaw producing a first pair of angled cuts before producing a second pair of angled cuts; said upper jaw having a curved operating surface facing the operating surface of the lower jaw means for moving said operating surface of the upper jaw in a substantially rolling motion over the operating surface of the lower jaw in combination with a motion bringing the upper jaw toward the lower jaw so that the motion which produces the first pair of angled cuts terminates before the second pair of cuts is produced, said motion for bringing the upper jaw toward said lower jaw being superimposed on said rolling motion in producing said angled cuts in sequence, said operating surface of said upper jaw having a curvature matching said rolling motion so that said angled cuts are produced with forces that are uniformly distributed during formation of said angled cuts.

2. A strapping device as defined in claim 1, including a housing; said upper jaw having an end facing away from the operating surface of said upper jaw, said end having a perforation; a cam interlocking with said perforation; a shaft for driving said cam; a lateral stop for securing said end in a groove in said housing and extending perpendicular to the operating surface of said lower jaw; said lateral stop having a pivoting axis positioned substantially in a plane that is the same as the plane of the operating surface of said upper jaw.

3. A strapping device as defined in claim 2, wherein said lower jaw has a midline, said shaft being positioned perpendicularly above said midline of said lower jaw, said groove extending also perpendicularly along said midline of said lower jaw.

4. A strapping device as defined in claim 2, wherein said cam has a pivoting motion with a lower dead point, said pivoting motion having predetermined sections of motion on each side of said lower dead point, said pivoting motion of said cam on said shaft being limited to said predetermined sections for carrying out a predetermined punching process by said upper jaw.

5. A strapping device as defined in claim 4, wherein said punching process is carried out with said jaws becoming initially active on a pair of angled cuts that are formed farthest away from said tensioning wheel and subsequently on a pair of angled cuts nearest said tensioning wheel.

6. A strapping device as defined in claim 2, including a sliding block in said groove and having a bore, said lateral stop having a round cross-section and engaging said bore.

7. A strapping device as defined in claim 6, wherein said sliding block has at least one lifter for engaging below edges of the ends of said strap between said jaws.

8. A strapping device as defined in claim 2, including a manually operated lever for pivoting said shaft with said cam.

9. A strapping device as defined in claim 7, wherein the operating surface of said upper jaw is substantially elongated toward said tensioning wheel and has a notching blade for separating a tensioned strap from a supply roll.

10. A strapping device comprising: a tensioning wheel for tensioning a section of a steel strap obtained from a supply roll and wrapped around a package with overlapping ends; a stationary lower jaw with an operating surface and an upper jaw, said upper jaw executing a punching motion to produce at least two pairs of angled cuts in and along said overlapping ends of said strap for fastening together said overlapping ends; said upper jaw producing a first pair of angled cuts before producing a second pair of angled cuts; said upper jaw having a curved operating surface facing the operating surface of the lower jaw means for moving said operating surface of the upper jaw in a substantially rolling motion over the operating surface of the lower jaw in combination with a motion bringing the upper jaw toward the lower jaw so that the motion which produces the first pair of angled cuts terminates before the second pair of cuts is produced, said motion for bringing the upper jaw toward said lower jaw being superimposed on said rolling motion in production said angled cuts in sequence, said operating surface of said upper jaw having a curvature matching said rolling motion so that said angled cuts are produced with forces that are uniformly distributed during formation of said angled cuts; a housing; said upper jaw having an end facing away from the operating surface of said upper jaw, said end having a perforation; a cam interlocking with said perforation; a shaft for driving said cam; a lateral stop for securing said end in a groove in said housing and extending perpendicular to the operating surface of said lower jaw; said lateral stop having a pivoting axis positioned substantially in a plane that is the same as the plane of the operating surface of said upper jaw; said lower jaw has a midline, said shaft being positioned perpendicularly above said midline of said lower jaw, said groove extending also perpendicularly along said midline of said lower jaw; said cam has a pivoting motion with a lower dead point, said pivoting motion having predetermined sections of motion on each side of said lower dead point, said pivoting motion of said cam on said shaft being limited to said predetermined sections for carrying out a predetermined punching process by said upper jaw; said punching process is carried out with said jaws becoming initially active on a pair of angled cuts that are formed farthest away from said tensioning wheel and subsequently on a pair of angled cuts nearest said tensioning wheel.

11. A strapping device comprising: a tensioning wheel for tensioning a section of a steel strap obtained from a supply roll and wrapped around a package with overlapping ends; a stationary lower jaw with an operating surface and an upper jaw, said upper jaw executing a punching motion to produce at least two pairs of angled cuts in and along said overlapping ends of said strap for fastening together said overlapping ends; said upper jaw producing a first pair of angled cuts before producing a second pair of angled cuts; said upper jaw having a curved operating surface facing the operating surface of the lower jaw means for moving said operating surface of the upper jaw in a substantially rolling motion over the operating surface of the lower jaw in combination with a motion bringing the upper jaw toward the lower jaw so that the motion which produces the first pair of angled cuts terminates before the second pair of cuts is produced, said motion for bringing the upper jaw toward said lower jaw being superimposed on said rolling motion in producing said angled cuts in sequence, said operating surface of said upper jaw having a curvature matching said rolling motion so that said angled cuts are produced with forces that are uniformly distributed during formation of said angled cuts; a housing; said upper jaw having an end facing away from the operating surface of said upper jaw, said end having a perforation; a cam interlocking with said perforation; a shaft for driving said cam; a lateral stop for securing said end in a groove in said housing and extending perpendicular to the operating surface of said lower jaw; said lateral stop having a pivoting axis positioned substantially in a plane that is the same as the plane of the operating surface of said upper jaw; said lower jaw has a midline, said shaft being positioned perpendicularly above said midline of said lower jaw, said groove extending also perpendicularly along said midline of said lower jaw; said cam has a pivoting motion with a lower dead point, said pivoting motion having predetermined sections of motion on each side of said lower dead point, said pivoting motion of said cam on said shaft being limited to said predetermined sections for carrying out a predetermined punching process by said upper jaw; said punching process is carried out with said jaws becoming initially active on a pair of angled cuts that are formed farthest away from said tensioning wheel and subsequently on a pair of angled cuts nearest said tensioning wheel; a sliding block in said groove and having a bore, said lateral stop having a round cross-section and engaging said bore; said sliding block has at least one lifter for engaging below edges of the ends of said strap between said jaws; a manually operated lever for pivoting said shaft with said cam; the operating surface of said upper jaw is substantially elongated toward said tensioning wheel and has a notching blade for separating a tensioned strap from a supply roll.

* * * * *